US005740319A

United States Patent [19]

Wedemeier

[11] Patent Number: 5,740,319

[45] Date of Patent: Apr. 14, 1998

[54] PROSODIC NUMBER STRING SYNTHESIS

[75] Inventor: Frederick C. Wedemeier, Richardson, Tex.

[73] Assignee: Texas Instruments Incorporated, Dallas, Tex.

[21] Appl. No.: 157,791

[22] Filed: Nov. 24, 1993

[51] Int. Cl.[6] ..... G10L 5/02

[52] U.S. Cl. ..... 395/2.75; 395/2.67; 395/2.81

[58] Field of Search ..... 395/2.79, 2.81, 395/2.67, 2.76, 2.69, 2.7, 2.75; 381/39

[56] References Cited

U.S. PATENT DOCUMENTS

| | | | |
|---|---|---|---|
| 3,328,132 | 6/1967 | Flanagan et al. | 381/39 |
| 4,092,493 | 5/1978 | Rabiner et al. | 395/2.46 |
| 4,211,892 | 7/1980 | Tanimoto et al. | 395/2.79 |
| 4,337,375 | 6/1982 | Freeman | 395/2.69 |
| 4,783,811 | 11/1988 | Fisher et al. | 395/2.76 |
| 5,384,893 | 1/1995 | Hutchins | 395/2.765 |

OTHER PUBLICATIONS

Text–To–Speech System for Greek Yiourgalis et al. IEEE/May 91.

*Primary Examiner*—Allen R. MacDonald
*Assistant Examiner*—Richemond Dorvil
*Attorney, Agent, or Firm*—Robert L. Troike; W. James Brady, III; Richard L. Donaldson

[57] ABSTRACT

A machine and method for providing human voice sounding numbers includes storing in digital form segments of leading digit utterance, segments of trailing digit utterances, group pausing utterances and digit pair utterances. A data string of segments is read out of storage and concatenated.

6 Claims, 1 Drawing Sheet

PROSODIC NUMBER STRING SYNTHESIS

TECHNICAL FIELD OF THE INVENTION

This invention relates to prosodic number string synthesis, and more particularly to means by which machine converted human receiver numbers do not have the mechanical sounding inflections.

BACKGROUND OF THE INVENTION

Prior art schemes have used recordings of a synthesis of ten digits played back to the user in the proper sequence. The primary drawback of this scheme is that the result is mechanical-sounding, without the inflections or "smoothing together" of digits as provided by a human speaker. Relating utterances to printed words, current synthesis typically sounds as though each digit was followed by a period. For example, "one. two. three. four. five. six. seven." Instead of "one-two three, four-five-six seven."

SUMMARY OF THE INVENTION

In accordance with the present invention, the utterance to be made is broken into components smaller than complete digits. A set of components are provided to provide the means to generate the inflection used by human speakers.

These and other features of the invention that will be apparent to those skilled in the art from the following detailed description of the invention, taken together with the accompanying drawings.

DETAILED DESCRIPTION OF THE INVENTION

Figure 1:
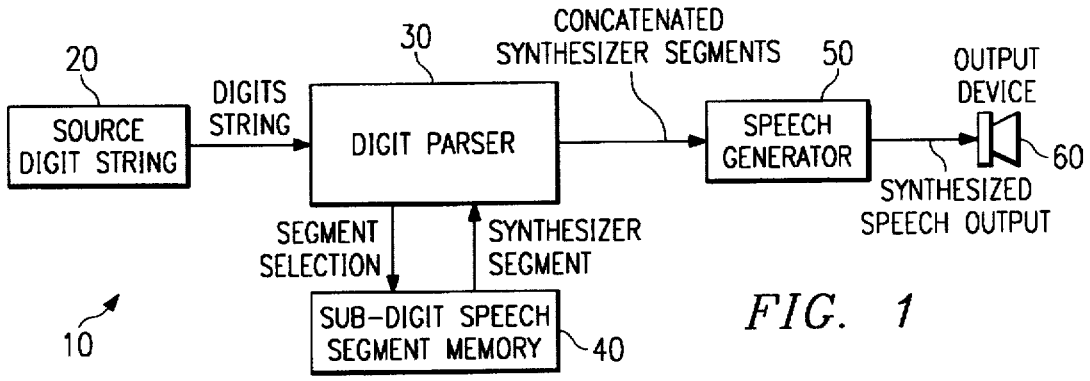
FIG. 1 is a block diagram of a system according to one embodiment of the present invention.

Referring to FIG. 1, there is illustrated a system 10, according to one embodiment of the present invention. A synthesized human voice is generated by speech generator 50 and sent to the output device 60, which may be a speaker, telephone receiver, or other audio device. The speech generator 50 converts digital speech data to analog voice frequency signals. Several such generators are well known in the art. One is a u-Law CODEC chip as used in the public telephone network. Another is a Linear Predictive Coding (LPC) synthesizer. The input to the speech generator 50 is set of concatenated digital data segments of the form required by the generator to form the desired synthetic human speech. According to the present invention, these concatenated segments are selected from a set of sub-digit speech segments in storage 40 by a digit parser 30 according to the desired digit string 20.

In accordance with the present invention, a number utterance is broken down into sub-digit components smaller than complete digits "zero" through "nine". The set of sub-digit components that are used provide the means to generate inflections used by human speakers. In the speech model used by the present invention; a digit utterance may occur in any of four places in a number string utterance:

The leading digit in a number string: The "1", for example, and "4" in the telephone number "123-4567".

The trailing digit in a number string: The "7" in the telephone number "123-4567".

At a group-pausing point in a string in a number string: The "3" in "123-4567".

Paired with any other single digit in a number string: "12","23 ", "45", "56" and "67" in the telephone number "123-4567".

As another aspect of the speech model used by the present invention, each digit is broken into two sub-digit components comprising the first and second part of the digit utterance.

A rough textual approximation of the first and second parts of the utterance is given in the following table:

| Digit | First Part | Second Part |
|---|---|---|
| 0 | z | zzzeeeero |
| 1 | w | wonne |
| 2 | t | toooo |
| 3 | th | reee |
| 4 | f | ffore |
| 5 | f | ffive |
| 6 | ss | sssiks |
| 7 | ss | ssseven |
| 8 | — | ate |
| 9 | nn | nnnine |

A total of 130 segments of digit utterances describe all possible spoken number strings:

10 First-part, leading-digit utterance segments (referred to as "<digit.l>" in this document).

10 Second-part, trailing-digit utterance segments (referred to as "<digit.t>" in this document).

10 Second-part, digit-group pause utterance segments (referred to as "<digit.p>" in this document).

100 Combination second part/first part, digit-pair utterance segments (referred to as "<digit><digit>" in this document).

By selection of the division points to have constant pitch, cadence, and volume between the first and second parts of the digits in the leading, pausing, trailing, and digit-pair cases, the means is provided to smoothly join these segments providing the various inflections typical of human-spoken number strings. It is therefore important in producing these segments that a constant pitch, cadence and volume be maintained.

For example, the local telephone exchange number "322-2333" is synthesized with the following concatenation of sub-digit utterance segments:

| | 3 leading | 32 digit-pair | 22 digit-pair | 2 group pause | 2 leading | 23 digit-pair | 33 digit-pair | 33 digit-pair | 3 trailing |
|---|---|---|---|---|---|---|---|---|---|
| Sub-digit utterance segments | 3.1 | 32 | 22 | 2.p | 2.1 | 23 | 33 | 33 | 3.t |
| Utterance | Th - | reet - | - tooot | - tooo, | Tt - | tooth | - reeth | - reeth | - ree. |

Figure 2:
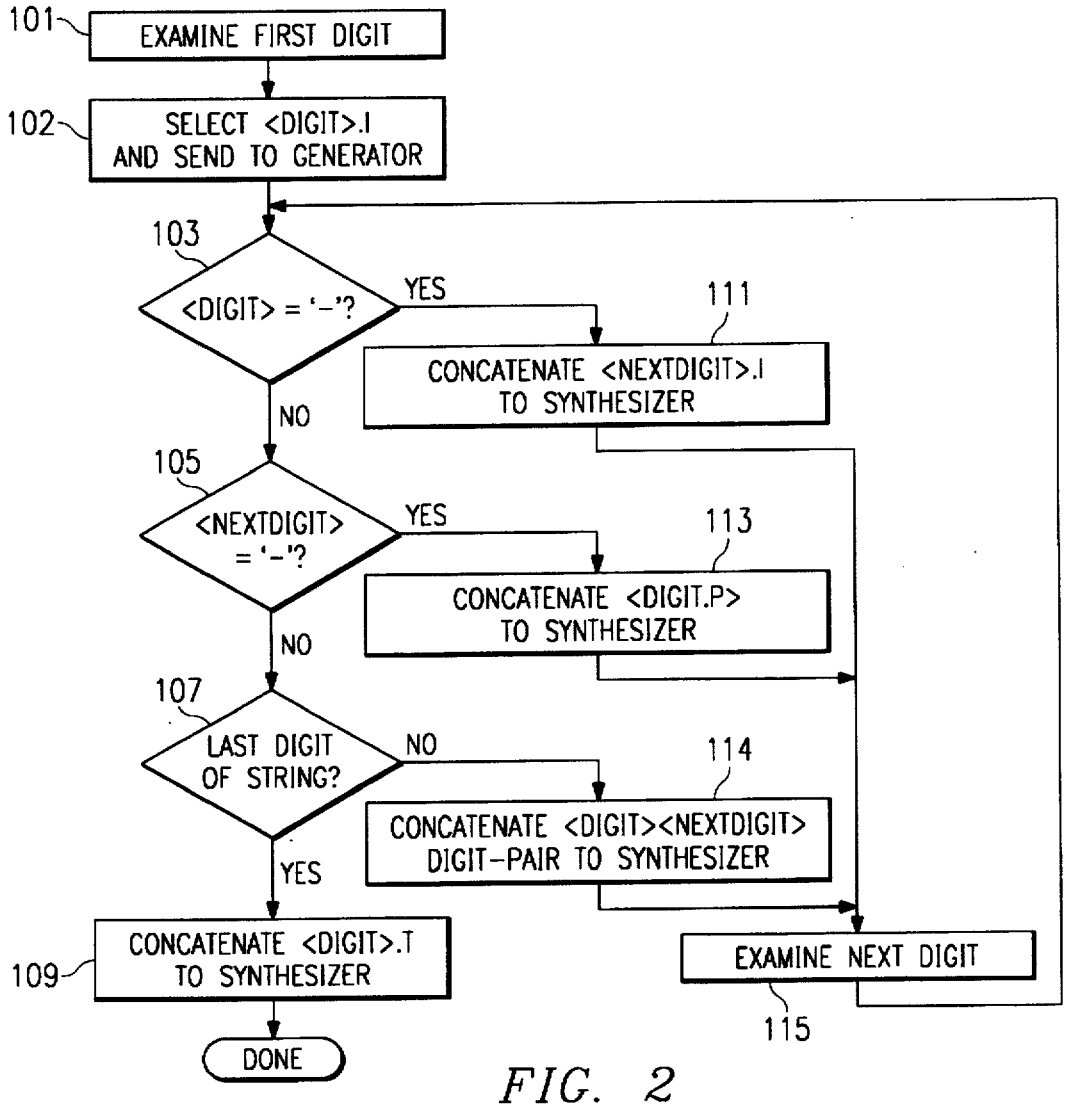
FIG. 2 is a flow diagram illustrating the operation of the digit parser of FIG. 1.

Referring again to FIG. 1, the digit parser 30 selects the desired subdigit speech segment from the aforementioned set of 130 segments at source 40 in accordance with the digit string from source 20 that is to be synthesized, and in accordance with the flow shown in FIG. 2. The digit parser in accordance with the preferred embodiment of the invention described herein includes a CPU with a program as indicated in FIG. 2. In FIG. 2, "digit" is numeric '0' '9'or '–' indicating a digit-group pause point, <digit> is current digit being examined in the digit string, and <nextdigit> is next digit to be examined in the digit string.

According to the programmed steps of FIG. 2, the first digit from source 20 is examined at Step 101 to determine what it is and the next Step 102 selects one of the sub-digit segments from memory 40 to pass on to the digital-to-analog generator 50. For example, if the first digit is a 2, the selection is for sub-digit "2.1", recalling the <digit.l> means the leading -digit utterance, in this example, for 2. The concatenate steps function to select the appropriate sub-digit segment from memory 40 corresponding to the received digit from source 20 and to append that segment's speech data to the data previously sent to the digital-to-analog generator 50. The Step 115 calls for examining the next digit from the string source 20. If the current digit is a pause ('–') as determined at Step 103, the Step 111 calls for concatenating leading digit (<nextdigit.l>) data for the next number in the string 20 to the generator 50. If the next digit is a pause (<nextdigit>='–') as determined at Step 105, Step 113 calls for concatenating as the second part of the digit-group pause segment (<digit.p>) from memory 40 to generator 50. If the digit is the last digit of a string, as determined at Step 107, Step 109 calls for concatenating the second part of the trailing -digit segment to generator. If not, Step 114 calls for concatenating the digit pair <digit> <next digit> to the generator 50 from memory 40.

Regarding creation of 130 sub-digit speech segments, note that the following set of numbers contain all sub-digit utterances:

| | |
|---|---|
| 123-4321 | 707-7172 |
| 010-2022 | 808-8182 |
| 311-4003 | 909-9192 |
| 414-1330 | 737-2748 |
| 442-0450 | 283-2938 |
| 055-3524 | 757-3949 |
| 515-5346 | 584-8768 |
| 656-6625 | 595-8854 |
| 360-2616 | 778-9879 |
| 063-6479 | 869-9967 |

All digit 0 . . . 9 at the beginning of a string (digit.1 segments).

All digits 0 . . . 9 at the end of a string (digit.t. segments).

All digits 0 . . . 9 preceding a '–' indicating a spoken pause (digit.p segments).

All digit pairs from 00 to 99 (second part/first part digit-pair segments).

Using a known electronic recording means such as the SUN sound tools found in SUN workstations, this set of digit strings (or other set of strings containing all sub-digit utterances) is spoken and recorded by a human speaker using constant pitch, cadence and volume, except where pitch and volume cues are used to indicate that a group-pausing or final digit is being spoken. Then, using a known electronic editing means such as the SUN sound tools, the segments are extracted and stored in the sub-digit speech segment memory 40 described in FIG. 1. SUN Workstations and SUN soundtools are products of SUN Microsystems, Inc. (2550 Garcia Ave, Mountain View, Calif. 94043). For example, the following segments are extracted from the number string "123-4321".

| | | | | | | | | | |
|---|---|---|---|---|---|---|---|---|---|
| 1.l | 12 | 23 | 3.p | 4.l | 43 | 32 | 21 | 1.t |
| Ww - | onnet | - tooth | - ree, | Ff - | fforth - | reet - | tooww- | wonne. |

There are several uses for a prosodic number string synthesis whereby a human user hears a number string. One such application can be from a source of a touch-tone pad or from a database or further, from a word recognition soilware, wherein it is desirable by human user to hear the number that he or she entered into the system. For the touch-tone pad call, the telephone receiver can respond with a machine generated voice message giving the sender the number sent. A machine voice message system, after requesting a social security number and having stored the number, may respond back with a voice message confirming the social security number received. Similarly, in a password to access a computer or database the computer may send a voice message. A voice recognition system may repeat back the voice message that it received and acknowledged. In accordance with the teaching herein, the source 20 for the data string can be from a touch-tone pad call, a machine generated voice message, a machine voice message system, or a voice recognition system responding back with a voice message confirming the number. The data string number may also be provided by keyboard entry, a database lookup, an optical character recognition system, an RS232 data link or a sequential number stored on a disc.

Other Embodiments

Although the present invention and its advantages have been described in detail, it should be understood that various changes, substitutions and alterations can be made herein without departing from the spirit and scope of the invention as defined by the appended claims.

What is claimed is:

1. A synthesizer for a human voice for numbers comprising:

means for storing human voiced leading-digit utterance segments, human voiced trailing-digit utterance segments, human voiced digit group pause segments, and human voiced digit pair utterance segments; and means coupled to said storage means and responsive to a data string of numbers for reading out for each digit a pair of said stored human voiced segments according to said string of numbers to produce a natural sound of a human voice.

2. A synthesizer for human voice for numbers comprising:

storage means for storing in digital form human voiced leading-digit utterance segments, human voiced trailing-digit utterance segments, human voiced group pausing utterance segments and human voiced digit-pair utterance segments;

means coupled to said storage means and responsive to a data string of numbers for reading out and concatenating said human voiced segments according to said data string of numbers; and digital-to-analog generator means responsive to said segments for providing natural sounding human voice speech output.

3. A method of providing a human voice sounding string of numbers comprising:

storing human voiced leading-digit utterance segments, trailing-digit utterance segments, group-pausing utterance segments, and digit-pair digit utterance segments; and reading out said stored segments of human voiced digit utterances according to a data string of numbers to produce natural sounding human voice speech.

4. The method of claim 3 wherein said storing step includes the steps of:

storing human voiced leading-digit utterances with constant pitch, cadence and volume;

storing human voiced trailing-digit utterances with constant pitch, cadence and volume;

storing human voiced group-pausing utterances with constant pitch, cadence and volume; and storing human voiced digit-pair utterances with constant pitch, cadence and volume.

5. A method of providing synthesized voice output of a numeric string comprising the steps of:

recording selected samples of actual human voice spoken numbers;

segmenting said actual human voiced spoken numbers into subdigit speech segments of more than one human voiced of leading-digit utterances, human voiced trailing-digit utterances, human voiced group-pausing or human voiced digit-pair utterances; and combining at least two of said subdigit speech segments according to desired spoken numeric string output to produce a natural sound of a human voice.

6. A method of providing a synthesized voice output of any numeric string comprising the steps of:

recording selected samples of actual human voiced spoken numbers, segmenting said actual human voiced spoken numbers into 130 subdigit speech segments including all digits 0 through 9 at the beginning of a string, all digits 0 through 9 at the end of a string, all digits 0 through 9 indicating a spoken pause, and all digit pairs from 00 to 99; and combining said subdigit speech segments to produce a natural sound of a human voice.

* * * * *